United States Patent [19]

Jackson et al.

[11] 4,042,384

[45] Aug. 16, 1977

[54] PRODUCTION OF METAL STRIP FROM POWDER

[75] Inventors: George Jackson, Sheffield; Terence Fieldsend, Rotherham, both of England

[73] Assignee: British Steel Corporation, London, England

[21] Appl. No.: 686,249

[22] Filed: May 13, 1976

Related U.S. Application Data

[63] Continuation of Ser. No. 462,991, April 22, 1974, abandoned.

[30] Foreign Application Priority Data

Jan. 31, 1974 United Kingdom ..... 4500/74
May 3, 1973 United Kingdom ..... 21103/73

[51] Int. Cl.[2] ..... B22F 1/00; B22F 7/00; B65G 53/04; B22F 3/18

[52] U.S. Cl. ..... 75/214; 75/208 CS; 302/31; 425/79

[58] Field of Search ..... 75/214, 208 CS, 200, 75/223, 224; 425/79; 302/17, 19, 31; 198/DIG. 4

[56] References Cited

U.S. PATENT DOCUMENTS

| | | | |
|---|---|---|---|
| 3,017,665 | 1/1962 | Dasher | 425/79 |
| 3,122,434 | 2/1964 | Reed | 75/208 CS |
| 3,198,499 | 8/1965 | Stanley | 302/31 |

FOREIGN PATENT DOCUMENTS

| | | |
|---|---|---|
| 1,212,681 | 11/1970 | United Kingdom |

*Primary Examiner*—Samuel W. Engle
*Assistant Examiner*—Donald P. Walsh
*Attorney, Agent, or Firm*—Bacon & Thomas

[57] ABSTRACT

Metal strip is continuously produced by compacting metal powder to form a green strip, feeding the green strip to a sinter furnace and supporting the strip on a gaseous cushion as it is transported through the furnace, the strip transport being controlled to maintain the tensile stress applied to the strip as it passes through the furnace substantially zero. The strip may be fed through the furnace by means of pinch rolls located at entry to and exit from the furnace, the respective speeds of rotation of the pinch rolls being interrelated to accommodate shrinkage of the strip as it passes through the furnace.

20 Claims, 7 Drawing Figures

PRODUCTION OF METAL STRIP FROM POWDER

This is a continuation, of application Ser. No. 462,991, filed Apr. 22, 1974.

This invention relates to the continuous production of metal strip and relates especially to the production of steel strip by the roll compaction of metal powder.

Processes have been proposed for the continuous production of metal strip and other forms by compacting powder. In these processes cold compaction alone is not sufficient to produce strip of a density and strength approaching that of strip rolled from an ingot. The compacted powder needs to be sintered, that is heated to a temperature at which the powder tends to bond together by incipient melting or high temperature solid state diffusion. Sintering may be followed by further compactions and heat treatments in order to obtain strip with suitable mechanical properties and surface finish. In this way it is proposed that strip of sufficient density and having mechanical properties comparable with those of strip rolled from an ingot may be produced.

Ideally, strip should be sintered in a continuous furnace, and to avoid the strip collapsing some support is required for it whilst it is in the furnace. It has been suggested that the support could be in the form of an endless metallic belt which travels through the furnace.

Attempts to produce metal strip in this manner have encountered a serious problem. Sintering the strip when it is supported on a belt does not produce strip having the desired mechanical properties because of tensile stresses applied to the compacted powder during sintering caused by the belt preventing shrinkage of the strip as it passes through the sinter furnace. In particular, the frictional restraint imposed by the belt on the strip as it attempts to shrink leads to ineffective sintering which results in surface cracking of the strip during subsequent rolling.

According to the present invention in one aspect a method is provided for the continuous production of metal strip which includes compacting powder to form a green strip, feeding the green strip to a sinter furnace and supporting the strip by a gaseous cushion as it is transported there through, the strip transport being controlled in such a manner that the tensile stress applied to the strip during its passage through the furnace is substantially zero.

The metal powder may be fed into the nip formed between two contra-rotating rolls of a compaction mill to produce green strip and the green strip may be supported by means of a floatation table prior to its entry to the sinter furnace. The green strip is driven through the sinter furnace by means of a pair of cooperating take off rolls located at the outlet from the sinter furnace. The green strip may be fed into the furnace by means of pinch rolls and the respective speeds of rotation of the pinch rolls and take off rolls may be interrelated to maintain the tensile stress applied to the strip during its passage through the sinter furnace substantially zero.

The term 'substantially zero tension' as used throughout this specification will be understood to refer to a tensile stress applied to the compacted powder whilst in the furnace of a value which permits the sintering strip to shrink. The tensile stresses applied to a compacted ferritic and austenitic stainless steel powder and to compacted mild steel powder preferably less than 50 and 70 kilo Newtons per square meter respectively. The tensile stress applied to a compacted mild steel powder is preferably less than 50 Kilo Newtons per square meter. For all these powder materials, the tensile stresses applied may suitably be less than 15 Kilo Newtons per square meter and preferably less than 10 Kilo Newtons per square meter. Expressed in another way, the tensile stresses applied to a strip produced from compacted metal powder is to be maintained at a value which permits the strip to shrink during sintering by at least 10% of the shrinkage which would occur under no applied tension. Preferably the tensile stresses applied should be less than 80% to 90% of the shrinkage which would occur under conditions of no applied tension. Compressive stresses may be applied advantageously to improve sintering as long as the application of such stresses does not cause the green strip to buckle as it passes through the furnace.

The support gas may consist of any gas or mixture of gases whose physical and chemical properties are compatible with the support system and material being processed. For example, the gaseous cushion may consist of argon, nitrogen or mixtures of argon and hydrogen, of nitrogen and hydrogen, or argon, nitrogen and hydrogen or of argon, hydrogen and methane. Preferably, the gas mixture comprises approximately 80% of the dense support gas (i.e. argon and/or nitrogen).

After leaving the sinter furnace, the sintered strip may be subjected to cold rolling to produce a reduction in thickness of the order of 20%. The sintered, rolled strip may then be passed through a reheat furnace prior to being subjected to further rolling to size. The reheat furnace may comprise a sinter furnace substantially as referred to above in which the strip is supported on a gaseous cushion as it passes through the furnace. Alternatively, the sintered, rolled strip may be re-passed through the first-mentioned sinter furnace prior to being subjected to further rolling to size. After each of the sinter, cold rolling and reheat stages, the strip may be coiled prior to being passed to the succeeding stages. Alternatively, one or more of these stages may follow one another without an intermediate coiling stage.

According to the present invention in another aspect, apparatus for the continuous production of metal strip comprises means for compacting powder to form a green strip, means for transporting the compacted green strip through a sinter furnace, means for feeding gas to the sinter furnace to produce a gaseous cushion to support the green strip as it passes through the sinter furnace, and means for controlling the strip transport means in such a manner that the tensile stress applied to the strip during its passage through the furnace is substantially zero.

The invention will now be described with reference to the accompanying diagrammatic drawings in which.

Figure 1:
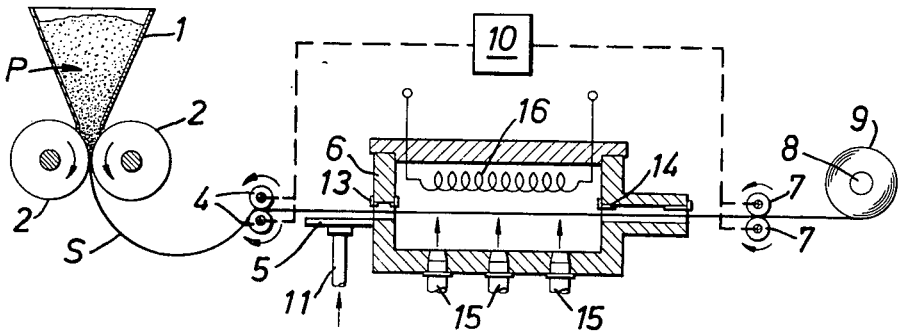
FIG. 1 is a side elevational view partly in section of apparatus for producing metal strip in accordance with the invention.
Figure 2:
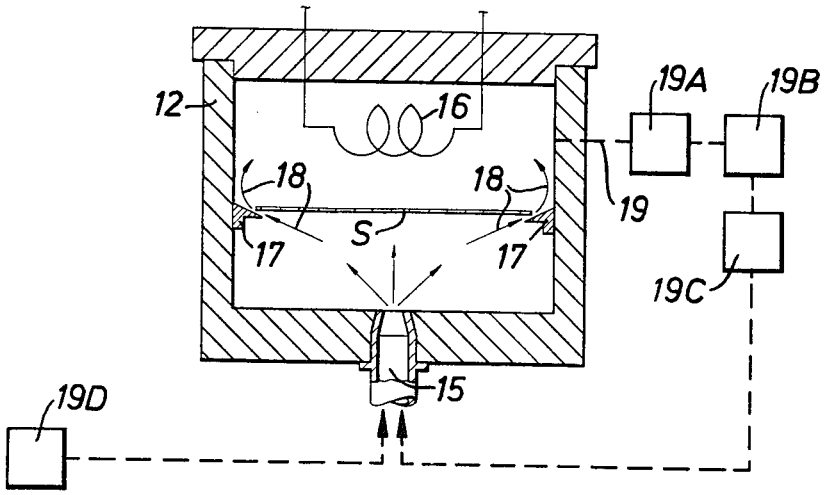
FIG. 2 is a section taken through a sinter furnace illustrated in FIG. 1.

The apparatus illustrated in FIGS. 1 and 2 includes a hopper 1 which contains powder "P". The powder may be manufactured from a ferrous material, for example mild steel ferritic or austenitic stainless steels, a non-ferrous material, such as aluminium, a metal bearing ore or a metallic oxide and the term metal powder as used herein is to be taken to include all such powders. Immediately below the hopper 1 a pair of compacting rolls 2 - 2 are arranged so that the powder which leaves the lower open end of the hopper 1 is drawn into the nip between the rolls 2 - 2. As illustrated, the rolls 2 - 2 are constrained to rotate in opposite directions and the whole assembly of rolls 2 - 2 and hopper 1 comprises a compaction mill from which green strip "S" is produced.

Downstream of the compaction mill are provided, in order, a pair of co-operating pinch rolls 4 - 4, a floatation table 5, a sinter furnace 6, a pair of cooperating take-off pinch rolls 7 - 7 and a strip coiler 8. The coiled strip is indicated by reference numeral 9. As illustrated, the green strip "S" from the compaction mill is fed over the floatation table 5 and through the furnace 6 to be propelled therethrough by the pairs of pinch rolls 4 - 4 and 7 - 7. The respective speeds of rotation of the leading pinch rolls 4 - 4 and take-off pinch rolls 7 - 7 are so interrelated that the tensile stress obtaining in the green strip as it passes through the sinter furnace 6 is substantially zero, for a green strip produced from an austenitic stainless steel powder, the tensile stress would be controlled to a value of less than 70 Kilo Newtons per square meter of cross-section and for a ferritic powder, to a value of less than 50 Kilo Newtons per square meter of cross-section. Thus, in order to accommodate shrinkage of the strip as it passes through the sinter furnace 6, the respective speeds of rotation of the pinch rolls are synchronised by a controller 10 so that the rotational speed of the rolls 7 - 7 is less than that of the rolls 4 - 4 by an amount corresponding to the expected linear reduction of the strip as it shrinks on passing through the furnace.

The expected shrinkage can be determined from a knowledge of the composition of the green strip, morphology of the metal powder and the conditions obtaining in the sinter furnace. For a strip produced from a stainless steel powder, a linear reduction of up to 5% may occur. Normally this linear reduction would be of the order of 1 to 2%. For a green strip produced from materials such as metallic oxides the linear reduction may be as great as 30 to 40%. The setting of the controller 10 may be automatically or manually controlled in accordance with a quality control via feed-back circuitry. Alternatively, the tensile stress within the strip may be sensed at some location intermediate the pinch rolls 4 - 4 and 7 - 7 and the stress so determined fed to the controller 10 to effect differential control of the rotational speeds of the pinch rolls. Preferably the tensile stress would be sensed at some location within the furnace.

The floatation table 5 has a flat horizontal surface and is positioned so as to occupy as much as possible of the intervening space between the pinch rolls 4 - 4 and the furnace 6. The table 5 has a gas inlet 11 and many small gas outlets (not shown) on its upper surface so as to support the green strip thereon prior to its entry into the furnace.

In an alternative embodiment, the floatation table is replaced by a pnenum chamber with sloping side walls similar to those employed in the furnace 6 and as illustrated in FIG. 2.

As will be seen more clearly from FIG. 2, the sinter furnace 6 has a refractory lining 12 and is provided with entry seals 13 and exit seals 14 located at each respective end of the furnace. Gas entry ports 15 are spaced along the underside of the furnace. Alternatively the gas entry ports 15 may be spaced along one or both sides of the furnace 6.

At least a part of the gas contained in the furnace 6 may be withdrawn through a conduit 19 and returned to the entry ports 15 via a cooler 19A, compressor 19B and a gas treatment chamber 19C in which impurities such as oxygen are removed. Additional gas from a source 19D of the required composition is added to the recirculating gas prior to its return to the furnace. Prior to re-entry to the furnace, the recirculating and additional gas are heated to a predetermined temperature.

Electrical heating elements 16 are incorporated inside the furnace 6 together with one or more temperature controllers (not shown). A pair of lips 17 are provided running horizontally along each of the vertical side walls of the furnace. In an alternative arrangement the lips 17 may be inclined downwardly by a small angle.

On leaving the sinter furnace 6, the strip is cooled, passes through the take-off pinch rolls 7 - 7 and is coiled by the strip coiler 8 to produce a coil of strip 9.

Figure 3:
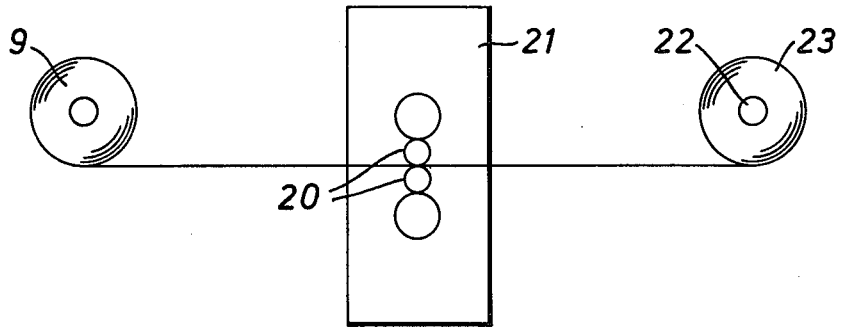
FIG. 3 is a side view of apparatus for cold rolling the strip produced by means of the apparatus illustrated in FIG. 1.

The coil is then conveyed to a rolling station as illustrated in FIG. 3. As illustrated, the strip is passed through the rolls 20 of a cold rolling mill 21 and recoiled by means of a strip coiler 22 to form a coil of strip 23.

In an alternative arrangement, the strip is subjected to hot rolling prior to cooling and coiling. In this alternative arrangement, the hot rolls would replace the take-off rolls 7 - 7 and their rotational speed controlled to maintain substantially zero tensile stress in the strip as it passes through the furnace.

Figure 4:
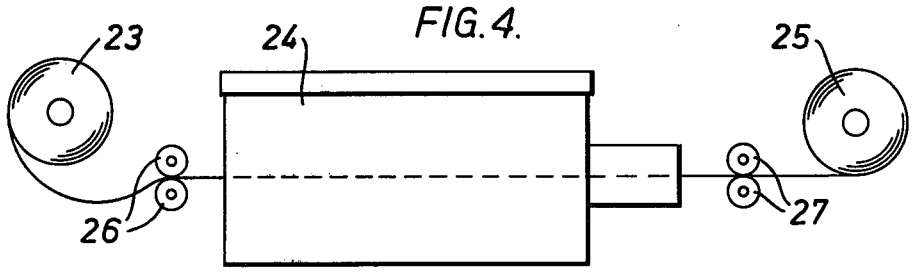
FIG. 4 is a side view of apparatus for reheating the rolled strip produced by means of the apparatus illustrated in FIG. 3.

As will be seen from FIG. 4, after re-coiling the coil 23 is conveyed to a reheating station in which it is passed through a furnace 24 and, once again, re-coiled to produce a coil of strip 25. The strip is conveyed to and from the furnace 24, respectively, by means of pinch rolls 26 and take-off pinch rolls 27. The furnace 24 may be identical to that illustrated in FIGS. 1 and 2. In an alternative embodiment, the coil 25 is returned to the sinter furnace 6 for reheating. Alternatively, the furnace may include a continuously moving belt which supports the strip as it is transported through the furnace 24.

Figure 5:
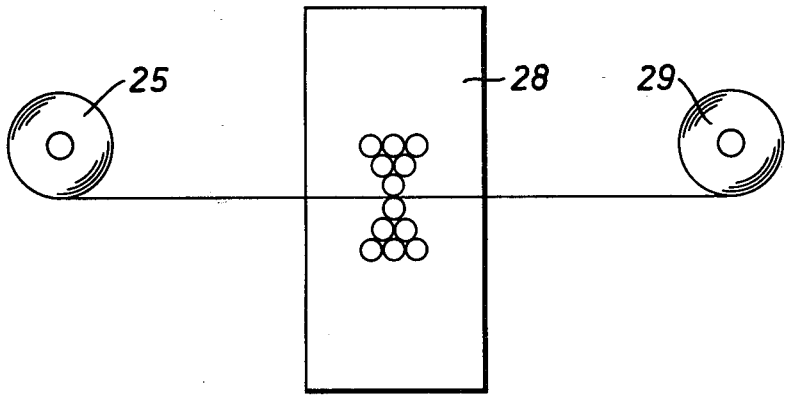
FIG. 5 is a side view of a Sendzimir mill for rolling the strip produced by means of the apparatus illustrated in FIG. 4, and FIGS. 6 and 7 are side elevational views partly in section of further apparatus for producing metal strip in accordance with the invention.

Finally, the coil of strip 25 is conveyed to a final rolling station as illustrated in FIG. 5 in which the strip is rolled to final thickness within a Sendzimir mill ("Z" mill) 28 and recoiled to form a final coil 29.

In operation of the apparatus illustrated, steel powder "P" from the hopper 1 is drawn into the nip between compaction rolls 2 - 2 and emerges as green strip "S". The strip is then guided by the pinch rolls 4 - 4 over the horizontal surface of the floatation table 5 into the furnace 6 via entry seal 13 and leaves the furnace by exit seal 14. The strip "S" is drawn from the furnace by the take-off pinch rolls 7 - 7 and coiled by means of the strip coiler 8.

Whilst in the furnace 6, the strip is supported by means of gas supplied under pressure through the gas inlet ports 15. Contact between the edges of the strip and the lips 17 located along the side walls of the furnace is minimised or prevented by gas which is permitted to flow between the strip edges and the inclined surfaces of the lips 17 as shown by arrows 18. The gas leaves the furnace through the conduit 19, is cooled, compressed treated and reheated before being returned to the furnace through the entry ports 15. Gas losses through the entry and exit seals 13, 14 are compensated for by addition of gas from the source 19D.

The gas supplied through the inlet ports 15 may comprise a mixture consisting of 20% by volume hydrogen and 80% by volume argon. Alternatively, the mixture may comprise a mixture of argon and a gas which reacts chemically with the strip. Thus, in order to increase the nitrogen or carbon content of the metal powder from which the strip is made, the mixture may consist, respectively, of argon and nitrogen or argon and a hydrocarbon gas such as methane. Thus, in order to increase by 0.2% the nitrogen content of an austenitic stainless steel strip, the gaseous composition may comprise 25% nitrogen, 55% argon and 20% hydrogen.

For a strip produced from a stainless steel powder the furnace temperature is maintained at approximately 1350° C by the heating elements 16 so that the strip "S" is sintered at the correct temperature. Whilst in the furnace 6, the tensile stress applied to the strip is maintained substantially zero due to the gas cushion on which it is supported and to the aforementioned synchronised interrelated rotational speeds of the pinch rolls 4 - 4 and 7 - 7.

The sintered strip is drawn from the furnace 6 by the take-off pinch rolls 7 - 7 and the strip coiler 8. The resulting coil 9 is then conveyed to the cold rolling mill 21 in which strip is uncoiled, passed through the rolls 20 - 20 and then re-coiled by means of the strip coiler 22. The rolls 20 - 20 effect a 20% reduction in strip thickness.

The coil 23 then passes to the reheating line illustrated in FIG. 4, the strip being uncoiled, passes through the furnace 24 by the pinch rolls 26 - 26 and 27 - 27 and then recoiled to produce coil 25.

Finally, the coil 25 is conveyed to the "Z" mill 28 in which it is rolled to final thickness and recoiled. The reduction in thickness achieved in the "Z" mill is normally of the order of 35% but may be considerably more as determined by the finished thickness and properties.

In an embodiment not illustrated, the sintered strip leaving the pinch rolls 7 - 7 is conveyed directly to the mill 21 without an intermediate coiling stage. In addition, or alternatively, the rolled strip leaving the mill 21 may be passed directly to the furnace 24 without a coiling stage intermediate the rolling line illustrated in FIG. 3 and the reheating line illustrated in FIG. 4.

The means of heating the furnaces 6 and 24 need not be electrical, but may for example be high frequency induction or electron beam apparatus.

Figure 6:
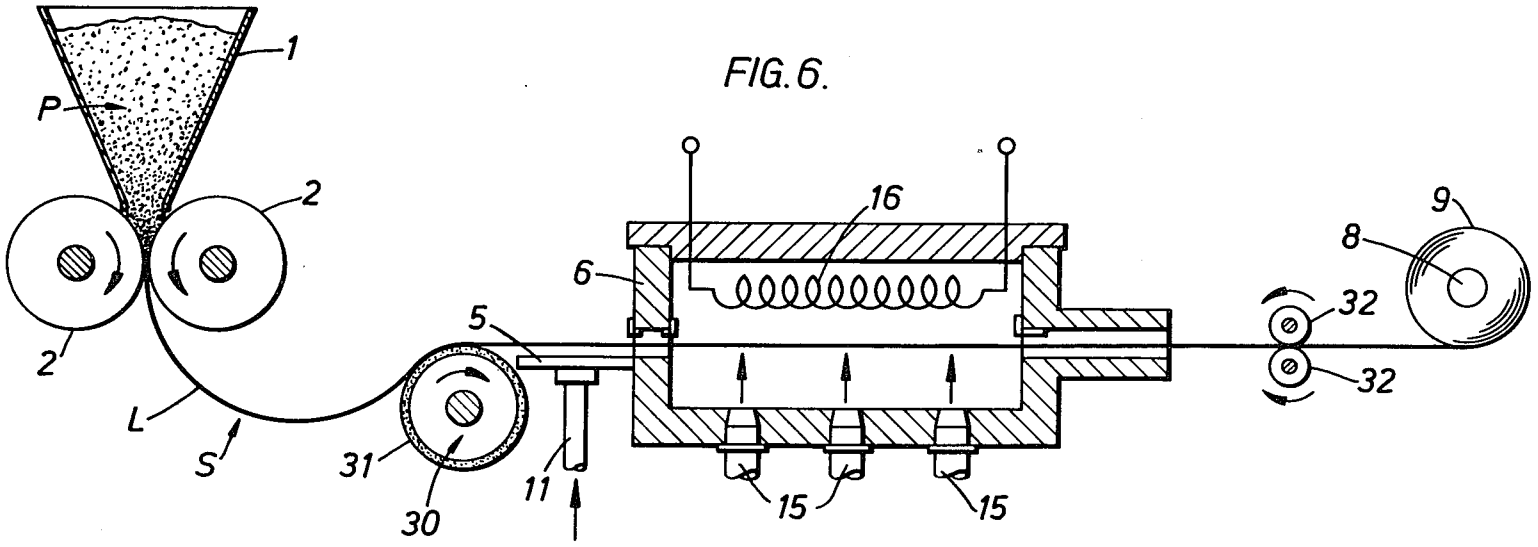

FIG. 6 illustrates an alternative way of achieving substantially zero tensile stress within the green strip "S" as it is being transported through the sinter furnace 6 on a gaseous cushion. In this alternative arrangement, in which like integers to those illustrated in FIG. 1 bear like reference numerals, a driven friction drum 30 is positioned intermediate the compaction rolls 2 - 2 and the floatation table 5.

The friction drum 30, which is motor driven, is provided with an outer circumferential covering of friction material 31 which is conveniently a cellular elastomer such as for example, foamed polyurethane. Such a material, besides providing a friction drive between its surface and the green strip passing thereover, is also resistant to the retention of powder thereon. Loose powder which may be picked up on the surface of the cellular material 31 as the strip passes thereover, will drop into the open pores thereon and will be removed therefrom by gravitational forces as the drum 30 rotates clear of the green strip.

In use the green strip "S" emerging from the compaction mill is fed around a part of the circumferential outer surface of the material 31 on the friction drum 30, over the floatation table surface 5, through the furnace 6 and between a pair of contra-rotating take off rolls 32-32 to the coiler 8. As in the FIG. 1 arrangement, whilst in the furnace 6 the green strip is supported by means of a gaseous cushion supplied through gas entry ports 15.

As mentioned previously, it is important that the tensile stress arising in the strip "S" is maintained substantially zero. In the arrangement illustrated in FIG. 6, the green strip hangs in a small catenary loop "L" between the compaction mill and the friction drum 30, but the speed of rotation of the friction drum 30 is so related to the speed of rotation of the compaction rolls 2-2 the take off rolls 32 - 32 and the coiler 8, that the tensile stress obtaining in the green strip is maintained substantially zero. Such tensile stress remains at the substantially zero level from the friction drum 30 onwards during its passage over the floatation table 5 and through the furnace 6. In operation the friction drum 30 is driven to provide a surface speed thereon which is slightly greater than the speed at which the green strip "S" emerges from the compaction rolls 2 - 2. The back tension obtaining in the strip as it enters the furnace 6 can be controlled to the desired zero level by regulating the height of the catenary loop "L". This regulation is achieved by adjusting the speed of rotation of the take off rolls 32 - 32 and the coiler 8 at the exit end of the furnace 6. Such speed adjustments may be carried out automatically in response to suitable sensor readings; the sensor may, for example, indicate the state of tension in the strip at its position where it passes over the floatation table 5.

Figure 7:
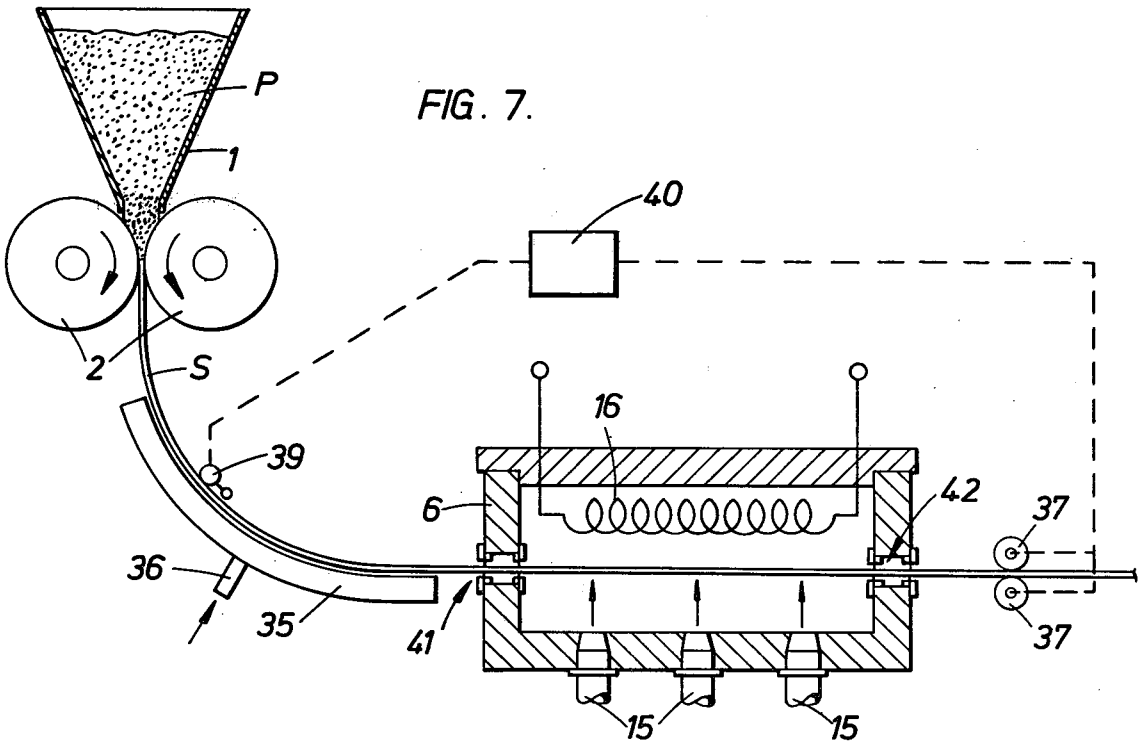

FIG. 7 illustrates further apparatus for achieving substantially zero tensile stress within the green strip "S" as it is being transported through the sinter furnace 6.

In this alternative arrangement a curved, downwardly inclined floatation table 35 is positioned between the compaction rolls 2 - 2 and the inlet port 41 of the furnace 6. Gas is conveyed to the floatation table 35 through a conduit 36. The furnace 6 is tilted through a small angle to the horizontal to enable the strip to flow through the furnace under gravitational force. The angle of the incline to the horizontal is such that the frictional drag of the strip passing through the furnace 6 is balanced by the gravitational forces acting on the strip, the angle may be of the order of 0.5° to 5° and is accomplished by locating the inlet port 41 of the furnace at a higher position than the outlet port 42. A sensor 39 determines the distance between the table 35 and the strip "S".

The strip is driven through the furnace by means of a pair of contra-rotating take off rolls 37 and the rotational speed of these rolls is controlled through a controller 40 to maintain the tension in the strip substantially zero by signals from the sensor 39 indicative of the tension on the strip "S". In this way, the strip back tension can be maintained at the desired value.

Although the invention has been described with reference to the production of metallic strip from a green strip produced by passing metallic powder through a compaction mill, it is to be understood that other methods of producing the green strip from a powder start material could be employed. One such alternative method includes the steps of depositing on a support surface a coating of a slurry comprising a suspension of powdered material in a binder composition, drying the slurry on the support surface to form a dried self-supporting film, removing the dried film from the support surface and rolling the dried film to effect compaction and form a green strip.

We claim:

1. A method of continuously producing metal strip from metal powder comprising the steps of continuously compacting the powder to form a continuous green strip, transporting the green strip to the entrance of a sinter furnace, isolating the green strip from tensile stresses imposed in the strip upstream of the entrance of the sinter furnace, propelling the strip through the furnace and sintering it while supporting it on a gaseous cushion, isolating the strip during sintering from stresses imposed in the sintered strip downstream of the furnace, and correlating the speed at which the sintered strip is drawn from the furnace with the speed at which the strip enters the furnace to permit the strip to shrink during sintering, the speed at which the sintered strip is drawn from the furnace being less than that at which it is transported to the furnace by an amount substantially corresponding to the linear reduction of the strip as it shrinks on its passage through the furnace.

2. A method according to claim 1 wherein the green strip is formed by feeding metal powder into and through the nip of a pair of contra-rotating rolls of a compaction mill.

3. A method according to claim 1 further comprising the steps of transporting the green strip to the entrance of the sinter furnace along the surface of a downwardly inclined floatation table, sensing the tensile stress present in the strip as it passes over the floatation table and controlling in accordance with the sensed values of tensile stress the speed at which the sintered strip is transported through the furnace.

4. A method according to claim 1 further comprising the steps of feeding the green strip into the sinter furnace by means of a pair of entry pinch rolls, withdrawing the sintered strip from the furnace by means of a pair of take-off pinch rolls located at the outlet of the sinter furnace and correlating the speeds of rotation of the entry and take-off pinch rolls to maintain the speed of rotation of the take-off rolls less than that of the entry rolls by an amount corresponding to the linear reduction of the strip as it shrinks on its passage through the furnace.

5. A method according to claim 1 further comprising the steps of feeding the green strip from a loop around part at least of the circumference of a rotatable drum provided with a friction surface at a speed sufficiently in excess of the speed at which the strip is being transported over the circumference of the drum to isolate the strip from tensile stresses imposed in the strip upstream of the drum, withdrawing the sintered strip from the furnace by means of a pair of take-off pinch rolls located at the outlet of the sinter furnace, and correlating the speeds of rotation of the friction drum and the take-off rolls to maintain the speed of rotation of the friction drum greater than that of the take-off rolls by an amount exceeding the linear reduction of the strip as it shrinks on passage through the furnace.

6. A method according to claim 1 wherein the path followed by the green strip as it travels through the sinter furnace is inclined downwardly with respect to the horizontal such that the frictional drag of the strip passing through the furnace is countered by the gravitational forces acting on the strip.

7. Apparatus for the continuous production of metal strip from metal powder comprising means for compacting the powder to form a green strip, means for transporting the green strip to the entrance of a sinter furnace, means for isolating the green strip from tensile stresses imposed in the strip upstream of the entrance of the sinter furnace, means for propelling the strip through the sinter furnace, means for feeding gas to the sinter furnace to produce a gaseous cushion therein to support the green strip as it passes through the furnace, means for isolating the strip during sintering from stresses imposed in the sintered strip downstream of the furnace, and means for correlating the speed at which the sintered strip is withdrawn from the sinter furnace with the speed at which the strip enters the furnace to permit the strip to shrink during sintering, the speed at which the sintered strip is drawn from the furnace being less than that at which it is transported to the furnace by an amount substantially corresponding to the linear reduction of the strip caused by shrinkage as it passes through the furnace.

8. A method of continuously producing metal strip from metal powder and sintering the strip while maintaining the tensile stress in the strip at a value less than 70 $kN/m^2$ comprising the steps of continuously compacting the powder to form a continuous green strip, transporting the green strip to the entrance of a sinter furnace, isolating the green strip from tensile stresses imposed in the strip upstream of the entrance of the sinter furnace, propelling the strip through the furnace and sintering it while supporting it on a gaseous cushion, isolating the strip during sintering from stresses imposed in the sintered strip downstream of the furnace, and correlating the speed at which the sintered strip is drawn from the furnace with the speed at which the strip enters the furnace to permit the strip to shrink during sintering without encountering stress in excess of 70 Kilo Newtons per square meter, the speed at which the sintered strip is drawn from the furnace being less than that at which it is transported to the furnace by an amount substantially corresponding to the linear reduction of the strip as it shrinks on its passage through the furnace.

9. A method as claimed in claim 8 wherein the tensile stress in the strip during sintering is maintained at a value less than 15 Kilo Newtons per square meter.

10. A method as claimed in claim 8 wherein the tensile stress in the strip during sintering is maintained at a value less than 10 Kilo Newtons per square meter.

11. A method as claimed in claim 8 wherein the metal strip is produced from austenitic stainless steel powder.

12. A method according to claim 11 wherein the tensile stress in the strip during sintering is maintained at a value less than 15 Kilo Newtons per square meter.

13. A method as claimed in claim 11 wherein the tensile stress in the strip during sintering is maintained at a value less than 10 Kilo Newtons per square meter.

14. A method as claimed in claim 8 wherein the metal strip is produced from ferritic stainless steel powder and wherein the tensile stress in the strip during sintering is maintained at a value less than 50 Kilo Newtons per square meter.

15. A method as claimed in claim 14 wherein the tensile stress in the strip during sintering is maintained at a value less than 15 Kilo Newtons per square meter.

16. A method as claimed in claim 14 wherein the tensile stress in the strip during sintering is maintained at a value less than 10 Kilo Newtons per square meter.

17. A method as claimed in claim 8 wherein the metal strip is formed from mild steel powder and wherein the tensile stress in the strip during sintering is maintained at a value less than 50 Kilo Newtons per square meter.

18. A method of continuously producing metal strip from metal powder and sintering the strip while maintaining the tensile stress in the strip at a value which permits the strip to shrink by at least 10% of the shrinkage which would occur under no applied tension, comprising the steps of continuously compacting the powder to form a continuous green strip, transporting the green strip to the entrance of a sinter furnace, isolating the green strip from tensile stresses imposed in the strip upstream of the entrance of the sinter furnace, propelling the strip through the furnace and sintering it while supporting it on a gaseous cushion, isolating the strip during sintering from stresses imposed in the sintered strip downstream of the furnace, and correlating the speed at which the sintered strip is drawn from the furnace with the speed at which the strip enters the furnace to permit the strip to shrink during sintering by at least 10% of the shrinkage which would occur under no applied tension, the speed at which the sintered strip is drawn from the furnace being less than that at which it is transported to the furnace by an amount substantially corresponding to the linear reduction of the strip as it shrinks on its passage through the furnace.

19. A method as claimed in claim 18 wherein the tensile stress in the strip is maintained at a value which permits the strip to shrink by at least 80% of the shrinkage which would occur under no applied tension.

20. A method as claimed in claim 18 wherein the tensile stress in the strip is maintained at a value which permits the strip to shrink by at least 90% of the shrinkage which would occur under no applied tension.

* * * * *